United States Patent [19]

Pettingill, Jr.

[11] 4,345,379

[45] Aug. 24, 1982

[54] TUBE MARKING DEVICE AND GAGE

[76] Inventor: Lucius A. Pettingill, Jr., 1855 Main St., Glastonbury, Conn. 06033

[21] Appl. No.: 320,052

[22] Filed: Nov. 10, 1981

Related U.S. Application Data

[63] Continuation-in-part of Ser. No. 171,812, Jul. 24, 1980, abandoned.

[51] Int. Cl.[3] ..... B43L 9/00

[52] U.S. Cl. ..... 33/21 R; 33/108 R

[58] Field of Search ..... 30/94, 95, 91.1, 90.6, 30/90.1; 33/42, 21 R, 21 D, 174 R, 168 R, 169 B

[56] References Cited

U.S. PATENT DOCUMENTS

| | | | |
|---|---|---|---|
| 2,009,671 | 7/1935 | Mueller et al. | 33/21 R |
| 2,235,575 | 3/1941 | Edwards | 30/90.6 |
| 2,275,867 | 3/1942 | Rybolt | 30/91.1 |
| 2,353,173 | 7/1944 | Martin | 30/91.1 |
| 3,395,457 | 8/1968 | Callahan | 33/174 R |
| 4,117,749 | 10/1978 | Economu | 30/90.6 |

FOREIGN PATENT DOCUMENTS

| | | | |
|---|---|---|---|
| 107890 | 7/1943 | Sweden | 30/91.1 |
| 604529 | 7/1948 | United Kingdom | 30/91.1 |

*Primary Examiner*—Harry N. Haroian

*Attorney, Agent, or Firm*—McCormick, Paulding & Huber

[57] ABSTRACT

This disclosure relates to a tube marking tool pivotally mounted in a housing such that the end of the tube can be placed in a bore provided for this purpose in the housing. A marking tool is pivotally mounted in the housing and when moved downwardly, relative rotational movement between the tube and the housing provides a mark on the tube at a predetermined distance from the end of said tube. This mark is then used to provide a convenient gage mark for indicating that the tube is properly made up with a fitting of conventional configuration.

5 Claims, 7 Drawing Figures

TUBE MARKING DEVICE AND GAGE

CROSS REFERENCE TO RELATED APPLICATION

This application is a Continuation-In-Part of Ser. No. 171,812 filed July 24, 1980, now abandoned by the same inventor and bearing the same title, now abandoned in favor of this application.

SUMMARY OF THE INVENTION

This invention relates generally to a tube marking device adapted to place a mark on a tube at a predetermined point spaced from one end of the tube in order that the tube can be subsequently made up with a flareless tube fitting and checked for proper installation by means of a "go" gage, which has a particular geometry corresponding to said predetermined mark spacing which is related to the geometry of the fitting.

The tube marking device provides a visible mark well outside the confines of the tube fitting itself after the latter is assembled with the tube, and said device preferably comprises an elongated housing having a slot communicating with a bore at one end of the housing, which bore is adapted to receive the tube. A marking tool is pivotally mounted at the opposite end of the housing such that it can be lowered downwardly after the tube is inserted in the bore in order to mark the tube. The inner end of the tube bore preferably includes a counter bore having a cross sectional size somewhat less than that of the bore, which counter bore is preferably somewhat larger than the inside diameter of the tube being marked so that any burr on the tube will not interfere with the precise marking accomplished with a marking device of the present invention. A gage is provided on the exterior of the housing to allow checking the marking so made.

The invention also contemplates the use of the above described marking device with a tube fitting gage for checking the tube and an associated tube fitting of conventional configuration for proper assembly. Preferably such a gage comprises a generally flat plate having one end marked "no go" and with a thickness such that it should not fit between the threaded nut portion of the tube fitting and a flange defined by the hex portion, at least when the threaded pparts of the fitting are made up. The opposite end of the plate is contoured so that a corner portion thereof defines a tab having an outside edge adapted to abut this flange on fitting part, a relieved portion to fit around the hex portion of the fitting, and a slotted portion which defines an index mark spaced a predetermined distance from the tab's outside edge. This distance is related to the spacing between the tube end and the above mentioned mark on the tube when the tube and tube fitting are properly made up. The relieved portion preferably includes a further gage surface for abutting the nut in this situation.

DETAILED DESCRIPTION

Figure 1:
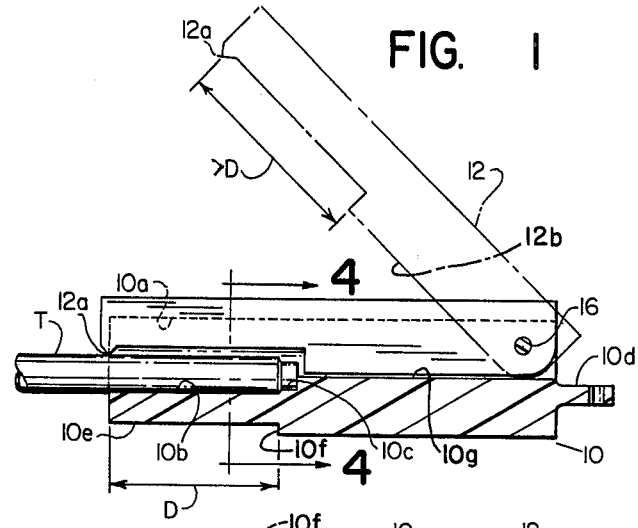
FIG. 1 is a vertical sectional view taken through a tube marking device constructed in accordance with the present invention and illustrates a scribing tool portion of the device shown in full lines in position for scribing a tube which is held in the device, said tool also being shown in phantom lines to illustrate an alternative position for the tool itself.
Figure 3:
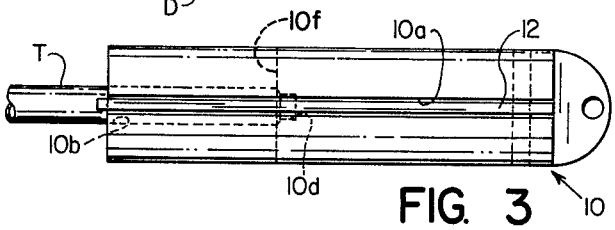
FIG. 3 is a top plan view of the device of FIG. 1.
Figure 2:
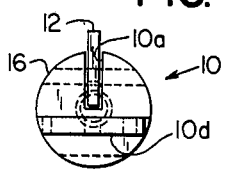
FIG. 2 is an end view of the device shown in FIG. 1.
Figure 4:
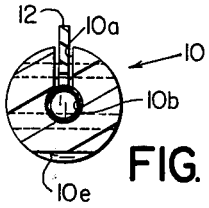
FIG. 4 is a sectional view taken generally on the line 4—4 of FIG. 1.

Turning now to the drawings in greater detail, FIG. 1 shows a housing, indicated generally at 10, which housing is preferably formed from a thermoplastic material such as nylon, or ryton, to the particular shape shown in FIGS. 1, 2, 3 and 4. The housing 10 is of elongated generally cylindrical configuration, as best shown in FIGS. 2 and 4, and defines an upwardly open elongated slot 10*a* extending the full length of the housing and adapted to receive a generally rectangular steel tube marking or burnishing tool 12. The tool 12 is best shown in FIG. 1 being illustrated there in full lines in position for marking a tube T when the tube is held in the position shown for it in FIGS. 1 and 3. The housing 10 and tube T are rotated slightly with respect to one another causing the tip portion 12*a* of tool 12 to leave a mark on the tube (such a mark being best illustrated at 14 in FIG. 5).

Still with reference to the tube marking device housing 10, it is noted that the bore 10*b* defined in the end of the housing opposite the pivoted end of the tool 12 in fact communicates with a portion of the upwardly open slot 10*a* but it is further noted that the slot 10*a* is somewhat narrower than the diameter of said bore as best shown in FIG. 3. Thus, the tube T can be snugly fit into the opening defined for this purpose in the end of housing 10 and it is a further feature of the present invention that the inner end of bore 10*b* is defined at a distance D from the location for the burnishing tip or point 12*a* on the tool 12 and this dimension D is best illustrated in FIG. 1. The inner end of the bore 10*b* is more particularly defined by an outwardly facing flange, which flange is defined by a slightly smaller diameter counterbore 10*c* which smaller bore 10*c* preferably has a cross sectional size somewhat less than that of the bore, but also slightly greater than the inside diameter of the tube (not shown). This configuration is preferred in order to assure that a burr or the like left on the inside of the tube, as a result of cutting the tube with a conventional tube cutter, will not adversely effect the critical placement of the mark 14 on the tube T as a result of utilizing the device of FIG. 1 in the manner just described. In fact, the tube T and any burr at its right hand end as it is placed in the bore 10*b* will project into the counterbore 10*c* and not be a factor in the measurement or location for the mark left by the burnishing tip on said tube T.

Another portion of the elongated slot 10*a* has an inner wall 10*g* which abuts a stop surface 12*b* on the tool 12 when the tube is being marked to assure that the burnishing tip 12*a* does not damage the tube during the marking thereof. Although tip 12*a* is not pointed, but has a radius to avoid any tendency to score the tube, the design of the movable tool 12 and its housing 10 assures that this tip 12*a* does not penetrate the surface of the tube being marked.

The housing 10 also includes a utility tab 10*d* with a suitable opening for receiving a restraining chain or the like. This will permit the device described above to be conveniently at hand when a workman has cut a tube and seeks to assemble this tube with a conventional tube fitting of the type illustrated in FIGS. 5, 6, and 7. As mentioned previously, the tool 12 is of generally rectangular metal configuration, and is more particularly in the form of a flat steel plate, with its right hand end pivoted to the housing by a roll pin 16.

Finally, and still with reference to the housing 10, the left hand end of the housing may include a flat 10*e* such that the marked tube can be visually checked to assure that the mark was properly made to the spacing D during the marking step referred to previously. This relieved region 10*e* serves as a convenient gage means in that the tube so marked can be placed against the radially extending stop surface 10*f* and the location of the mark 14 is then checked as being precisely at the end of the housing (where the tip 12*a* of tool 12 is located during the marking described previously). It will be apparent that the stop surface 10*f* must be in the same radial plane as that of the inner end of bore 10*b* for this gage means to serve its intended purpose.

Figure 7:
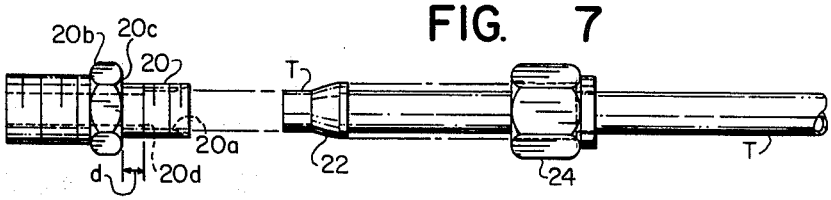
FIG. 7 is an exploded view of the tube fitting and the tubing to be inserted therein and illustrates the disassembled condition for this conventional assembly with the tube scribed as described.

Turning next to a more complete description of the "go" "no go" gage and the manner of using this gage in connection with a marked tube and tube fitting, FIG. 7 shows a conventional threaded tube fitting portion 20 of the type which has one end 20*a* adapted to receive the end of a tube T, and more particularly to receive the ferrule which seals the tube T in this fitting portion 20. The ferrule 22 is conventionally applied to the end of the tube after the tube has been marked in the manner described previously, and a conventional threaded nut 24 is provided on the tube T as also shown in FIG. 7. The tube fitting portion 20 also includes an integral hex portion 20*b* and these components are conventionally fabricated with precision so as to assure that the dimensions thereof are maintained within a critical range or tolerance, a factor which makes the present invention a very satisfactory method for assuring that the tube T and the tube fitting 20, 22 and 24 are all properly assembled with one another in a particular installation.

Figure 5:
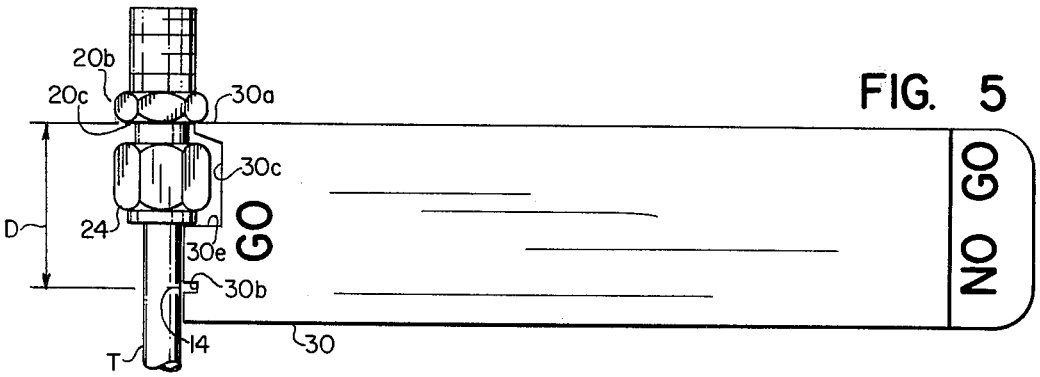
FIG. 5 is a plan view of a tube fitting gage suitable for use with a tube fitting and scribing tool to illustrate the "go" condition for an acceptable assembly.

The manufacturers of such tube fittings typically provide for the flange 20*c* of hex portion 20*b* to be precisely located with respect to the inner end of the opening 20*a* for the tube T. FIG. 7 shows such inner end at 20*d* and the dimension d of such a fitting. This dimension d may be taken as a constant, and can for certain tube fitting manufacturers be taken as equal to zero. In the latter situation the dimension D in FIG. 5 will correspond to the dimension D in FIG. 1. In use, one need only make up the tube fitting part 20 in the manner described so as to provide the configuration shown at the left hand side of FIG. 5. A "go" "no go" gage 30 is then held with one edge 30*a* against the flanged portion 20*c* of the integral nut 20*b* with the result that a notch 30*b* in the end of the gage 30 will align itself with the mark 14 previously applied by the marking device as described above. A clearance opening or relieved portion 30*c* is provided in the gage 30 so as to allow this measurement to be taken without interference from the threaded nut 24. An additional check is afforded by observing that the edge 30*e* of this relieved portion 30*c* abuts the nut 24 as shown in FIG. 5. The gage 30 is a generally rectangular plate with one edge configured in the manner just described and with the opposite end configured or formed with a thickness such as indicated at 30*b*, which thickness will not permit this end of the gage to be inserted between the flange 20 and the nut 24 when the tube and fitting have been properly made up.

Figure 6:
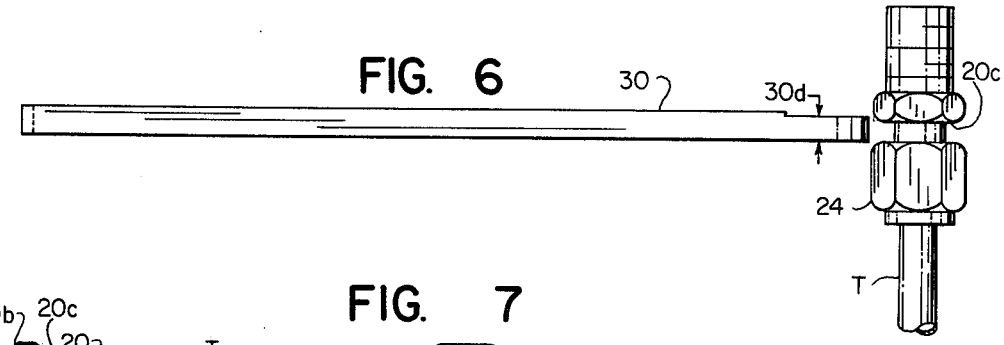
FIG. 6 is a view of the same tube and tube fitting assembly from FIG. 5 but illustrating the gage in a "no go" position with respect thereto.

By way of summary then the marking device described above with reference to FIGS. 1–4 inclusively permits one to provide a mark 14 on a tube T in order that the tube, when assembled with a conventional tube fitting, can be conveniently checked by a gage, such as that shown at 30 in FIGS. 5 and 6 with one end of the gage being used as a "go" gage and the opposite end being simply a "no go" type gage. The advantage of the present invention relates particularly to the "go" side of such a gage in that the mark 14 on the tube T must of necessity be a predetermined distance from the flange 20*c* of the hex portion 20*b* in a conventional tube fitting when the various components of the tube fitting (best shown in FIG. 7) are properly made up as described. Because of the general practice among tube fitting manufactures of locating hex flange 20*c* in a precisely determined relationship to the inner end 20*d* which will abut the end of the assembled tube T in a "good" assembly. The distance D in FIG. 5 will correspond to the distance D in FIG. 1 for a tube marking tool designed to mark a particular size tube for a correspondingly sized fitting.

I claim:

1. A device for marking a tube at a predetermined distance from the tube end such that assembly of the tube with a fitting will not obscure the marking, said device comprising:

(a) a generally cylindrical elongated housing having an elongated slot open along one side of the housing, said housing defining a central bore defined axially therein and open to one end of said housing to receive the tube to be marked, (b) said bore having an inner end intermediate the ends of said housing and said slot having a portion communicating with said bore, and another portion of said slot defined by said housing and having an inner wall which is parallel and closely spaced to th axis of said housing, (c) a tube marking tool of approximately the same length as said elongated housing and located at least partially in said slot, said tool having marking means at one end and having its other end pivotally mounted in said housing slot adjacent the other end of said housing, (d) said tool having a stop surface spaced from said pivotally mounted other end which stop surface abuts said inner wall of said housing slot when said tool is in its active position for marking a tube, whereby said marking means at said one end of said tool cannot penetrate the surface of the tube being marked and can only burnish the tube in the marking made thereon.

2. The tube marking device of claim 1 further characterized by gage means defined on the exterior of said housing, said gage means comprising a relieved region adjacent said one end of said housing and defined at least in part by a radially extending stop surface located in the same radial plane as the inner end of said bore so that the tube so marked can be visually checked by holding its end to said radially extending stop surface and ascertaining whether the marking is then located at the said open end of said housing, said marking means in said active position also located at said one end of said housing and in diametrically opposed relationship to said relieved region in said elongated housing.

3. The tube marking device of claim 2 wherein the inner end of said bore more particularly comprises a counter-bore having a cross sectional size slightly less than that of said bore and slightly greater than the inside diameter of the tube to be marked, said radially extending stop surface associated with said relieved region having a radial extent at least approximately equal to the radial difference between said bore and said counter-bore.

4. The tube marking device of claim 3 further characterized by a gage for checking a tube after assembly with a fitting having a hexagonal portion and a nut spaced from the hexagonal portion by a predetermined distance when the tube and fitting are properly made-up, said gage comprising a flat plate having one end with a "no go" thickness such that it should not fit between the hexagonal fitting portion and the nut and having an opposite end which is contoured so that a corner portion of the plate defines a tab having an outside edge adapted to abut a radial flange on said hexagonal portion, and said opposite end having a relieved portion shaped to fit loosely around the threaded nut, and said opposite end defining an index mark spaced from said outside edge of said tab by a dimension related to the axial dimension of said gage means defined by the relieved region adjacent said one end of said housing.

5. The method of checking a tube and tube fitting with the device of claim 4 comprising the steps of:

(a) inserting the tube end in the bore, (b) rotating the housing relative to the tube with the marking tool held in its active position so that said stop surface is held against the inner wall of the housing slot to provide a mark on the tube, (c) holding the marked tube against the relieved region so that the tube end abuts the radially extending stop surface associated with said relieved region to ascertain whether the mark is in the same radial plane as that of said tube marking means and the end of said housing, (d) placing the flat plate opposite end against the tube fitting and visually inspecting the tube mark to determine whether the mark is within a desired range defined by said index mark of said flat plate gage.

* * * * *